United States Patent [19]

Lima et al.

[11] Patent Number: 4,846,901

[45] Date of Patent: Jul. 11, 1989

[54] METHOD OF MAKING IMPROVED SILVER-TIN-INDIUM CONTACT MATERIAL

[75] Inventors: Antonio Lima, E. Providence, R.I.; Yuan S. Shen, Reading, Mass.

[73] Assignee: Engelhard Corporation, Menlo Park, N.J.

[21] Appl. No.: 129,272

[22] Filed: Dec. 7, 1987

[51] Int. Cl.[4] ..... C23C 8/10

[52] U.S. Cl. ..... 148/13.1; 148/284; 29/874; 200/266

[58] Field of Search ..... 148/131, 11.5 Q, 13.1, 148/20.3, 6.3; 219/137 R; 228/160, 191; 29/874, 877, 879

[56] References Cited

U.S. PATENT DOCUMENTS

| | | | |
|---|---|---|---|
| 3,814,640 | 6/1974 | Shibata | 29/874 |
| 4,050,930 | 9/1977 | Motoyoshi et al. | 200/266 |
| 4,431,462 | 2/1984 | Gould et al. | 148/11.5 Q |
| 4,636,270 | 1/1987 | Shibata | 148/431 |
| 4,647,322 | 3/1987 | Shibata | 148/431 |
| 4,695,330 | 9/1987 | Shibata | 148/63 |

*Primary Examiner*—Christopher W. Brody

[57] ABSTRACT

A novel method of producing a silver, tin-indium oxide contact material is disclosed. The material is fabricated by alloying silver with tin and indium, hermetically joining two sheets of such alloy with a layer of release material therebetween to form a multilayer structure, internally oxidizing the structure at elevated pressure and separating it into component parts. The inventiive process produces a member substantially free of oxide depleted regions about at least one surface.

19 Claims, 5 Drawing Sheets

SILVER-TIN-INDIUM OXIDE MATERIAL
MADE BY CONVENTIONAL METHODS

SILVER-TIN-INDIUM OXIDE MATERIAL
FABRICATED IN ACCORDANCE WITH INVENTION

IMPROVED SILVER-TIN-INDIUM OXIDE
MATERIAL WITH SILVER BACKING

METHOD OF MAKING IMPROVED SILVER-TIN-INDIUM CONTACT MATERIAL

TECHNICAL FIELD

The present invention relates to silver-tin-indium oxide contact materials useful in electric motor control circuits and like applications, and more particularly, such materials formed by internal oxidation of the tin and indium present in an alloy consisting principally of silver.

BACKGROUND OF INVENTION

Preferred contact materials for commercial applications must be resistant to both erosion and welding inasmuch as arc temperatures in an electrical contact environment can approach several thousand degrees centigrade. It was thus realized early on that fine silver needed to be strengthened in order to be suitable for such demanding applications. One of the first means employed, and still in use today, was (and is) oxide-dispersion strengthening with cadmium oxide. Silver-cadmium oxide contact materials have been fabricated by a variety of methods.

One method involves the preparation of a silver and cadmium oxide powder mixture followed by sequentially pressing, sintering and extruding the resulting material to form a contact material. Generally speaking, such contact materials include from about 5 to about 20 percent cadmium oxide dispersed in a silver matrix. The sintered material possesses excellent anti-weld properties, but the erosion resistance of such contact materials is only considered fair. This latter drawback is probably due to the fact that materials prepared as above typically contain up'to approximately two percent void space.

As an alternative to the above method of forming a silver-cadmium oxide contact material, it has been found that alloying fine silver with about 13.5 percent by weight of the total mixture cadmium oxide followed by: (a) drawing the alloy into a wire; (b) oxidation of the cadmium in the wire by internal oxidation; (c) chopping the wire into granules; (d) compacting pressing and sintering, the granules into ingot; and finally, (e) extruding the sintered wire into a shaped body; produces a contact material possessing both good erosion and anti-weld characteristics.

Generally speaking, it is possible to internally oxidize certain components in silver alloy sheets, such as cadmium (or indeed, a variety of metals) in a silver matrix since silver oxide decomposes at the lower temperatures required to oxidize certain other metals. Thus, it is possible to obtain a domain of other metal oxides disposed in a silver matrix by internally oxidizing an alloy by simply heating the alloy in an oxygen atmosphere at temperatures to form about 1400 to about 1600 degrees Fahrenheit (760° to 870° C.).

A third conventional method of producing silver-cadmium oxide contact material consists of alloying fine silver with about 13.5 percent cadmium, extruding the alloy or rolling it into a sheet, and oxidizing the sheet in a furnace at 1550° F. (840° C.) in an atmosphere consisting substantially of oxygen. The sheet thus produced also exhibits erosion-resistant and anti-weld properties, but it has been observed that when oxidized simultaneously from both sides, the sheet exhibits an oxide-depleted central region. This effect is believed to occur through a diffusion-type mechanism and produces undesirable non-uniformities in the final product.

With respect to the internal oxidation of a silver-cadmium sheet, it was proposed to weld two such sheets together along their interface in an airtight or hermetic fashion prior to internal oxidation and separating the sheets or slabs after internal oxidation was carried out. This method was found to produce a product which exhibited an oxide depleted layer at one surface (i.e. the internal interfacial surface between the formerly welded plates) which was, in any event, satisfactory, inasmuch as the single oxide-depleted surface could be used for brazing or otherwise metallurgically affixing the material to a suitable mount. In this regard, fine silver is a preferable surface for brazing, soldering or like methods, as opposed to the oxide-dispersion strengthened materials typically used as contact materials. On the other hand, the outer surfaces of the silver cadmium oxide sheets so produced had uniform metal oxide domains and were thus most suitable for use as a contact material.

Concerns over the possible toxicity of silver/cadmium contact materials have led to formulation of alternate oxide-dispersion strengthened/silver matrix materials. U.S. Pat. Nos. 3,933,485 and 3,874,941, both to Shibata for example, disclose silver-tin-indium oxide materials for use as electrical contacts.

Silver-tin-indium oxide materials may be processed similarly to the more conventional contact materials described hereinabove, although they have slightly different processing characteristics. For example, if one processes a single sheet of silver-tin-indium sheet by simultaneously oxidizing both surfaces as noted above in connection with cadmium oxide, one obtains an oxide depleted central region, and fine silver exudes to the two opposed outer faces of the sheet (sometimes referred to as diffusion creep) resulting in two additional oxide depleted layers. This latter phenomenon does not appear to occur with silver/cadmium materials upon internal oxidation.

Exudation of pure silver produces drawbacks that the silver surfaces tend to tack-weld in the early stage of device operation, although one silver-rich surface may help achieve the desired surface properties for brazing.

It is known to internally oxidize a sheet or slab of silver-tin-indium coated with fine silver as described in U.S. Pat. No 4,647,322 to Shibata. According to the '322 patent, sheets of fine silver are roll-bonded to opposed surfaces of a silver-tin-indium slab and the resulting structure is then internally oxidized. Following oxidation of the tin and indium, the structure exhibits centrally located oxide depleted region. In order to produce a usable contact material, the slab is sliced or sawed along the central depleted region, thereby removing the oxide depleted layer and producing two sheets of contact material.

The foregoing method of Shibata has several drawbacks, including the cost associated with slicing or sawing the internally oxidized structure through its center and the criticality involved in the cutting process.

It is accordingly an object of the invention to produce more efficiently a silver-tin-indium oxide contact material.

It is another object of the invention to eliminate machining steps in the fabrication of such materials.

A further object of the invention is to produce a silver-tin-indium oxide contact material with at least one uniform dispersed oxide surface following internal oxidation.

Still further objects and advantages of the present invention will become readily apparent upon consideration of the following detailed description, figures and claims.

SUMMARY OF INVENTION

It has been discovered that silver-tin-indium alloy sheets, hermetically and separably joined about their peripheries and internally oxidized to form an oxide-dispersion strengthened contact material, exhibits no oxide depleted layer about the surfaces internally disposed with respect to the multilayered body. This phenomenon is quite remarkable, inasmuch as single sheets of the identical composition exhibit a central oxide-depleted layer, as well as outer oxide depleted layers on both surfaces of the sheet which are believed due to exudation.

More specifically, the silver matrixed tin-indium oxide contact material of the present invention may be made by alloying silver with about 3 to about 10 percent tin and with about 1 to about 7 percent indium; rolling the alloy so prepared into sheets, disposing the sheets in face to face relationship with a layer of separating material therebetween and joining the sheets along their edges to form a hermetically sealing, or airtight joint. The composite formed as above is internally oxidized under pressure in an atmosphere consisting of oxygen and subsequently separated into two sheets to produce an oxide domain substantially uniformly distributed about the internal surfaces.

The inventive process can be carried out substantially continuously with rolls of alloy sheet or in a stepwise manner with a plurality of discrete sheets.

Alloys with about 4 to about 8 percent tin and about 2 to about 5 percent indium or alloys with about 6 to about 9 percent tin and about 3 to about 7 percent indium comprise preferred concentration ranges, with sheet thicknesses up to about 0.20 inches. The internal oxidation step referred to above may be carried out at temperatures from about 1200° to about 1600° F. under pressures from about 20 to about 70 PSIG for periods of from about 40 to about 200 hours.

BRIEF DESCRIPTION OF FIGURES

The invention is described in detail below with reference to the accompanying figures, in which.

DETAILED DESCRIPTION

The present invention enables one to fabricate silver-tin-indium oxide contact materials with at least one surface which is substantially free of an oxide depleted region. Prior to internal oxidation, a sheet or slab consisting of from about 3 to about 10 percent tin, about 1 to about 7 percent indium and the balance silver is prepared by conventional alloying procedures.

EXAMPLE I (Comparative Example)

Figure 2:
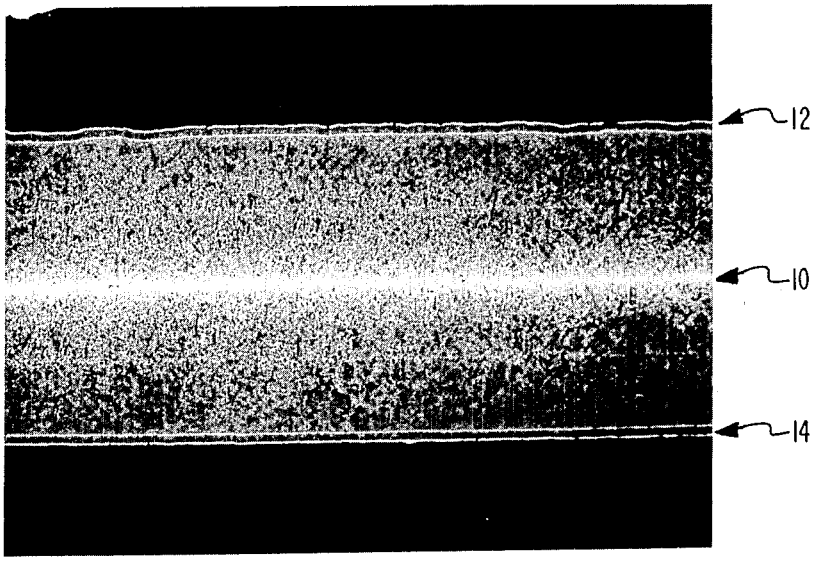
FIG. 2 is a photograph of an internally oxidized plate in cross section of silver-tin-indium by way of oxidation of both faces.

A sheet with the thickness of 0.075" of 6 percent tin, 4 percent indium, the balance being silver was alloyed by methods known in the art and placed in a substantially pure oxygen atmosphere at 1550° F. and 50 PSIG for 80 hours. The sample was then removed and cut perpendicularly to the exposed faces to reveal the cross section shown in FIG. 2. As may be seen from FIG. 2, its center as well as upper and lower faces 12, 14 exhibit oxide depletion, i.e. layers 10, 12 and 14 consist principally of fine silver.

EXAMPLE II

Figure 1:
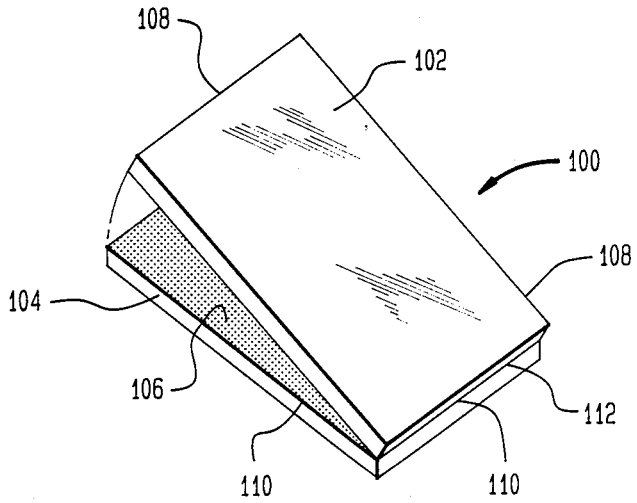
FIG. 1 is a perspective view of a partially assembled multilayer structure in accordance with the present invention.

FIG. 1 illustrates the assembly of a multilayer structure 100 fabricated in accordance with the present invention. There is provided a first sheet 102 and a second sheet 104 in face - to - face juxtaposed relationship as shown. Both sheets are of about 0.050 inches in thickness and consist of 6 percent tin, 4 percent indium, the balance being silver. There is disposed between the sheets a layer 106 of limestone (calcium carbonate) powder having a particle size of about 1 to 2 microns. The sheets 102, 104 are welded along their respective peripheries 108, 110 to form an airtight perpheral seam 112 along all four sides in the fully assembled state. The seam, it should be noted, is only peripheral and does not extend to the interfacial region. The plates may be joined by any suitable method, but arc-welding using a non-consumable electrode, or a 'electroless' welding method is preferred.

The assembled structure with airtight seam 112 along all four edges (i.e. forming a hermetically sealed interface) is placed in a pressurized oven having an atmosphere of pure oxygen. The structure is thus internally oxidized for 70 hours at 1550° F. while maintaining the pressure in the oven at 30 PSIG. Following internal oxidation, peripheral seam 112 is cut and the sheets 102, 104 separated. The plates are readily separable due to limestone layer 106 therebetween.

Figure 3:
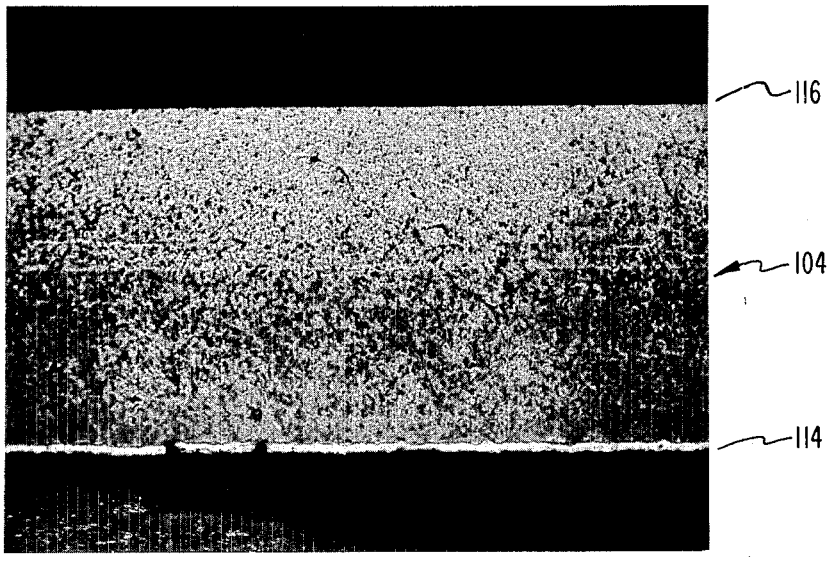
FIG. 3 is a photograph of silver-tin-indium plate in cross section internally oxidized in accordance with the invention.

FIG. 3 is a photograph (magnification 50X) of the cross section of a sheet 104. As may be seen, face 116 formerly the internal face adjacent layer 106, is substantially free of oxide depletion thereabout and there is a substantially even distribution of the metal oxide domain. The external face 114 of the plate exhibits a fine silver, i.e. oxide depleted, surface. Surface 114 has a uniform metal oxide domain and thus may be used as a contact surface without further processing or machining. If so desired, sheet 104 may be provided with a fine silver backing 118 (FIG. 4) by roll bonding or other methods which are well-known to those of skill in the art.

INDUSTRIAL APPLICABILITY

Figure 5:
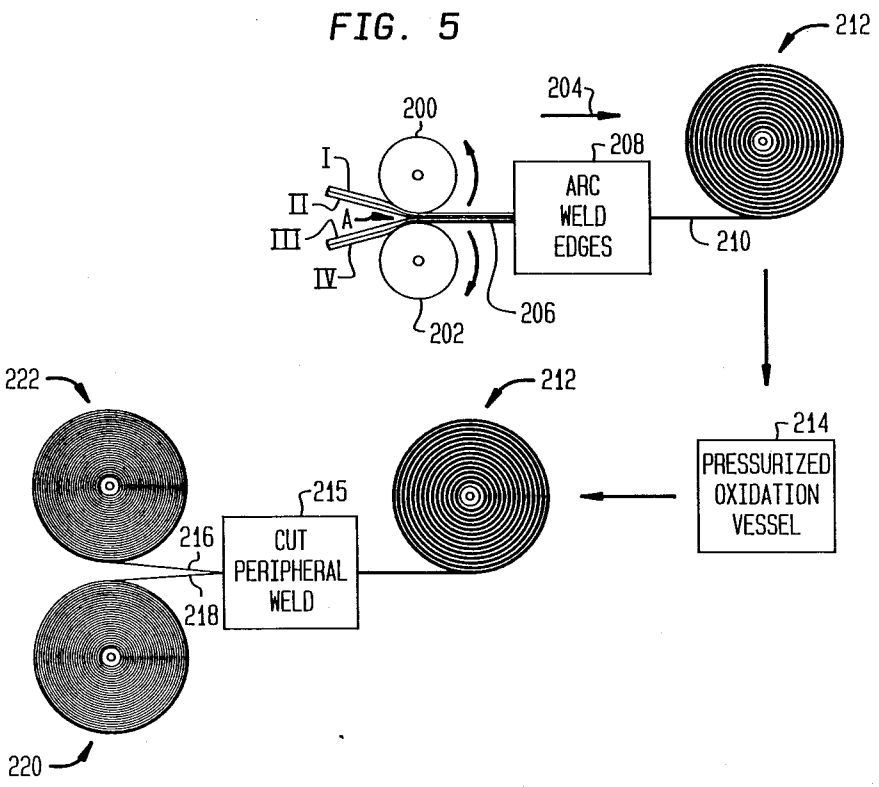
FIG. 5 is a schematic diagram of a continuous process for fabricating contact material in accordance with the invention.

Rather than fabricating contact materials on a piecewise basis as described hereinabove, in large quantities it is desirable to produce material on a continuous or semi-continuous basis as will now be described in connection with FIG. 5.

At a starting point there is provided four continuous rolls of materials indicated I through IV in the Figure (feed reels not shown). I and IV represent fine silver backing material used for brazing the finished product to a mount, and II and III represent strips of silver-tin-indium alloy as in the above example. Members I and IV are pre-hot-bonded on II and III respectively Strips I through IV are approximately 6 inches in width, and are 0.0075 inches thick. If so desired, other dimensions may be selected. At point A, a fine powder (lime powder) is introduced between the strips II, III.

The strips are fed between mandrels 200, 202 along the direction of arrow 204. The entire multilayer structure 206 is thus tightly compressed prior to being fed to an automatic welding apparatus 208. In apparatus 208 strips II, III already compressed, are welded (along their edges only) to form a composite, separable body, 210. Preferably, welding is carried out by arc welding with non-consumable electrodes (electroless welding) although various other methods of joining members II, III may be used. The composite 210 thus formed is wound onto a single take-up reel 212.

When a composite of the desired length has been formed, which may be anywhere from 5 to several hundred meters long, reel 212 is removed and placed into a pressured furnace, indicated at 214 in the figure.

Internal oxidation is carried out in the furnace simply by maintaining the interior (oxygen atmosphere, preferably substantially pure) at about 30 PSIG at a temperature of 1550° F. for 120 hours. After oxidation is thus completed, the composite 210 may be separated into two parts having the cross section illustrated in FIG. 4.

Figure 4:
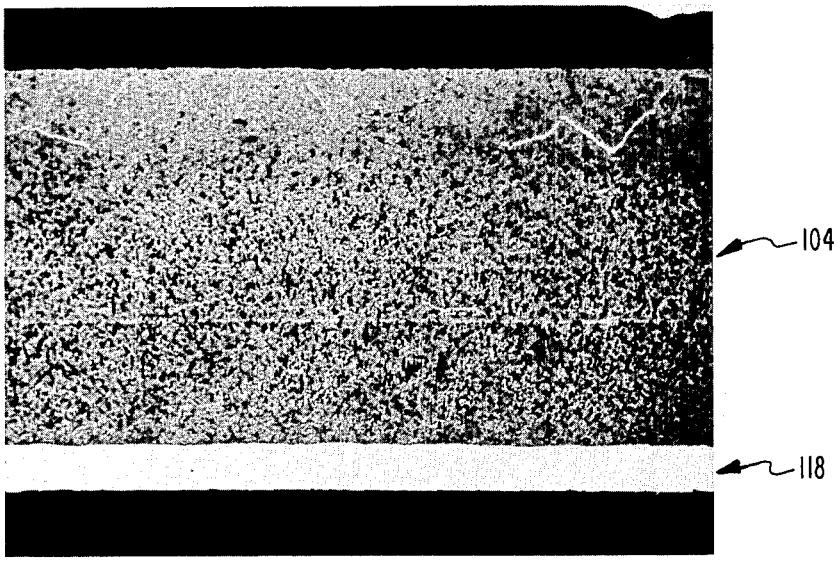
FIG. 4 is a photograph of a silver-tin-indium plate as in FIG. 3 provided additionally with a roll-bonded fine silver backing.

The same is accomplished by feeding the material through an edge cutter 215 which removes the edges provided earlier at 208. Following edge removal the two halves, 216, 218 of the composite having a cross-section as shown in FIG. 4 are wound onto take up reels 220, 222.

The ends of strips II, III must also be welded prior to internal oxidation to minimize end effects.

The limestone is easily removed after cutting at 214, since the internal oxidation temperatures are far below those required to cause substantial alteration or degradation of the limestone. In this regard, other suitable refractory powders, such as alumina, silica, kaolin, or mixtures thereof could be used in connection with the inventive process.

While the present invention has been described in connection with several embodiments and examples, various modifications will be apparent to those of skill in the art. For example, instead of using two alloy sheets as described above, a tube of suitable alloy could be split along its length and crushed to form a multilayer structure which may then be internally oxidized in accordance with the present invention. Such modifications are within the spirit and scope of the present invention, which is defined in the appended claims.

We claim:

1. A method of producing a silver matrixed tin-indium oxide contact material comprising the sequential steps of:

(a) alloying silver with from about 3 to about 10 percent by weight tin and from about 1 to about 7 percent indium;

(b) forming the alloy of step (a) into at least two distinct sheets;

(c) disposing the sheets in face-to-face opposed relationship with a layer of separating material therebetween to form a joinable multilayer structure of at least two distinct lamina consisting of the alloy sheets;

(d) metallurgically joining the multilayer structure about its periphery to form a hermetically sealing joint between the sheets along at least two edges, whereby the sheets remain separable;

(e) internally oxidizing the multilayer structure of step (d) in an oxygen containing environment with both faces of the structure remaining exposed to the oxygen-containing atmosphere such that the tin and indium of the sheets oxidize to form a dispersed domain of metal oxide portions within said silver matrix which is substantially free of oxide-depleted regions about the interfacial region between the sheets; and (f) separating the sheets by cutting the peripheral joint therebetween.

2. The method according to claim 1, wherein the silver is alloyed with from about 4 to about 8 percent tin and with about 2 to about 5 percent indium.

3. The method according to claim 1, wherein the silver is alloyed with from about 6 to about 9 percent tin and with about 3 to about 7 percent indium.

4. The method according to claim 1, wherein said separating material comprises a refractory powder.

5. The method according to claim 1, wherein said separating material comprises powdered limestone.

6. The method according to claim 1, wherein a layer of fine silver is roll-bonded onto both outer surfaces of said multilayer structure.

7. The method according to claim 1, wherein said internal oxidation is carried out at a temperature of about 1200° F. to about 1600° F.

8. The method according to claim 7, wherein said internal oxidation is carried out at a pressure of about 20 to about 70 PSIG.

9. The method of claim 8 wherein said step of internal oxidation is carried out for from about 40 to about 400 hours.

10. The method according to claim 9, wherein each of said separable sheets has a thickness of below about 0.200 inches.

11. The method according to claim 1, wherein said sheets are substantially continuous sheets and are hermetically joined about their edges by electroless arc welding.

12. A method of forming a silver matrixed tin-indium oxide contact material comprising internally oxidizing a separable, multilayer structure including at least two silver, tin, indium, alloy layers hermetically joined about their periphery on at least two sides thereof in opposed facing relationship such that the internal faces of said two sheets are substantially free of oxide depleted regions and separating said two sheets whereby the surface regions of the two sheets formerly disposed in facing relationship to each other have a substantially evenly distributed domain of metal oxide and are free of oxide depleted portions.

13. The method according to claim 12, wherein the silver is alloyed with from about 3 to about 10 percent tin and with about 1 to about 7 percent indium.

14. The method according to claim 12, wherein said separating material comprises a refractory powder.

15. The method according to claim 12, wherein said separating material comprises powdered lime.

16. The method according to claim 12, wherein a layer of fine silver is roll-bonded onto the outer surfaces of said multilayer structure prior to internal oxidation.

17. The method according to claim 12, wherein said internal oxidation is carried out at a temperature of about 1200° to about 1600° F.

18. The method according to claim 12 wherein said internal oxidation is carried out at a pressure of about 20 to about 70 PSIG.

19. The method according to claim 12, wherein said sheets are substantially continuous sheets and are hermetically jointed about their longitudinal edges by electroless arc welding.

* * * * *